United States Patent [19]

Gibbons et al.

[11] 4,351,684

[45] Sep. 28, 1982

[54] PNEUMATICALLY OPERATED APPLICATOR AND METHOD OF APPLYING ADHESIVE TAPE

[75] Inventors: Ralph D. Gibbons; Geoffrey G. Shackleford, both of Basingstoke, England

[73] Assignee: Lansing Bagnall Limited, Hampshire, England

[21] Appl. No.: 257,612

[22] Filed: Apr. 27, 1981

[30] Foreign Application Priority Data

Apr. 29, 1980 [GB] United Kingdom ..... 8014054

[51] Int. Cl.[3] ..... B29C 17/04; B29C 27/22

[52] U.S. Cl. ..... 156/215; 156/444; 156/475; 156/482; 156/486; 156/DIG. 6; 156/DIG. 38; 53/399; 53/589; 226/95; 271/98

[58] Field of Search ..... 156/475, 476, 482, 486–493, 156/444, DIG. 38, DIG. 6, DIG. 7, 215; 53/590, 583, 584, 582

[56] References Cited

U.S. PATENT DOCUMENTS 2,065,957 12/1936 Wrange ..... 156/568 X 3,116,193 12/1963 Ehlenbeck ..... 156/215

3,222,240 12/1965 Carter et al. ..... 156/486 X

*Primary Examiner*—David A. Simmons

*Attorney, Agent, or Firm*—Cushman, Darby & Cushman

[57] ABSTRACT

A pneumatic tool for use on a robotic arm for applying adhesive tape around bundles of wire, cables and the like. Three hollow tubes are disposed in line abreast and extend from a body which includes a chamber with an inlet port to which pneumatic pressure or suction can be applied and two oppositely acting ball valves of which one is in communication with the central tube and the other is in communication with the interior of the outer tubes, which are hollow but which have a respective lateral aperture on the side facing the central tube. On the application of suction, the central tube can hold a length of adhesive tape and the tool can be advanced into contact with the bundle of wires around which the tape is to be applied. On the application of pneumatic pressure, the central tube releases the tape and the pressure applied to the interior of the outer tubes advances them forwardly, against the force of a return spring. Air jets issue from the lateral apertures in the tube to force the tape around the bundle of wires.

11 Claims, 2 Drawing Figures

PNEUMATICALLY OPERATED APPLICATOR AND METHOD OF APPLYING ADHESIVE TAPE

BACKGROUND OF THE INVENTION

This invention concerns a pneumatically operated applicator for adhesive tape and a method of applying such tape. It is particularly, although not exclusively, intended for use at the end of a robotic arm in the automatic binding of cables or wires with a short length of adhesive tape.

One use to which an embodiment of the invention may be put is in the production of wiring harnesses as described in, for example, European patent application No. 79301087.7, and in particular the embodiment may be used in the stage illustrated by FIG. 10 of that application as published on the 20th February 1980. However, the invention may have a more general utility in the application of a short length of adhesive tape around a cable, bundle of wires, pipe or like object.

SUMMARY OF THE INVENTION

The present invention is based on the use of a tube, to which suction is applied to enable the tube to hold a length of tape at a mouth at one end of the tube, two elongate probes which can be advanced, one on each side of the tube, so as to wrap the tape partly around the bundle of wires, cable or the like, and the provision of at least one pneumatic jet directed across the mouth of the tube from at least one of the probes. The probes may constitute pistons and may be hollow; at least one of them may be adapted to convey pneumatic pressure to the region of the mouth of the tube and to direct a jet laterally.

In a preferred embodiment of the invention the tool comprises three hollow tubes of which at least the ends are disposed abreast and which comprise a central tube which has an open end and two outer tubes of which at least one has at least one lateral aperture on its inner side; a body from which the tubes extend, the body being adapted for the reception of pneumatic pressure and suction; and means within the body for applying suction to the central tube and for applying pneumatic pressure to the outer tubes so as to cause relative movement of the tubes such that the aperture is disposed further forward than the end of the central tube. The central tube may be fixed relative to the body whereas the outer tubes may be arranged, on reception of pneumatic pressure, to be advanced relative to the body and the central tube. Preferably there are lateral apertures in both the outer tubes and preferably the outer tubes are spring biased so as to return to their original positions on release of the pneumatic pressure to the outer tubes. It is also preferred that the suction and pressure is applied to the tubes by way of a valve arrangement which has an inlet port, at which vacuum pressure or suction can be received indifferently, and two oppositely acting valves communicating respectively with the central tube and the outer tubes, so that when the suction applied to the central tube is released, pressure is applied to the outer tubes.

DESCRIPTION OF A PREFERRED EMBODIMENT

Figure 1:
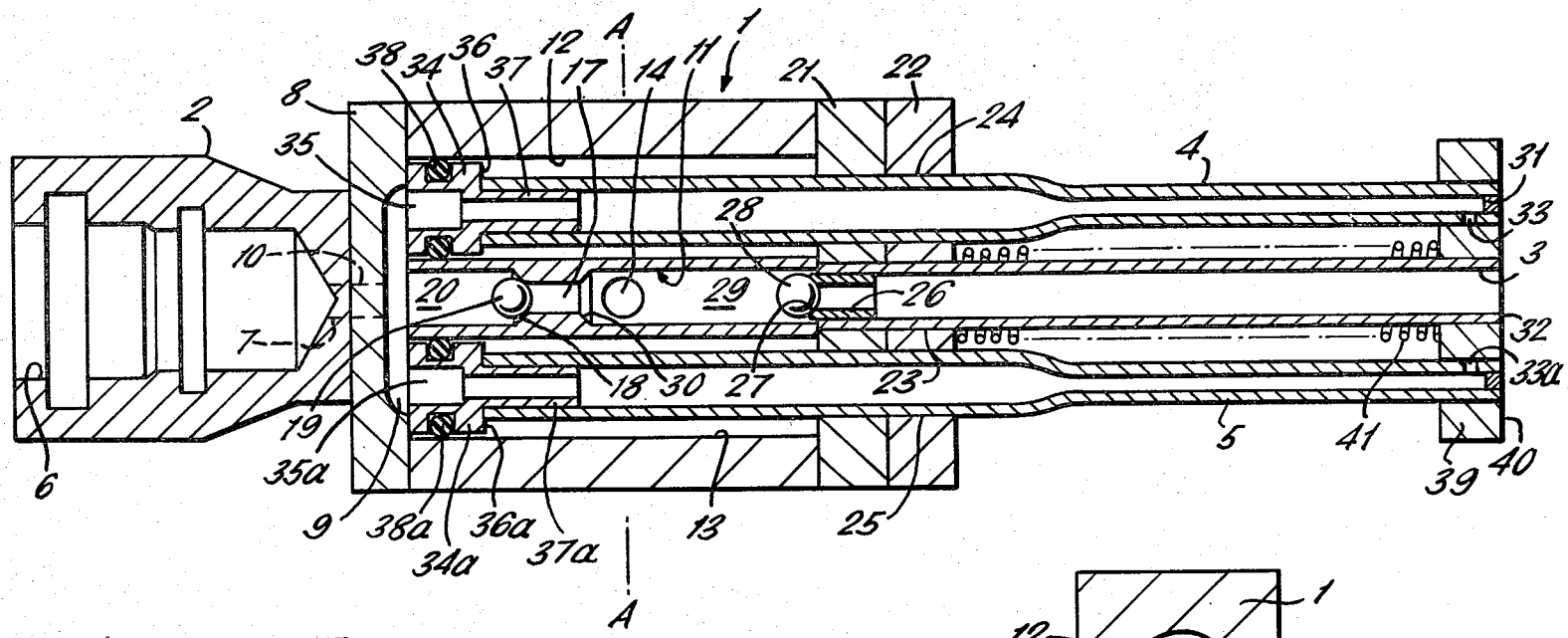
FIG. 1 is a sectional view of one embodiment of the invention.

The particular embodiment which is illustrated is intended for use in the automatic production of wiring harness as described in the aforementioned Application, but has a more general utility.

It is intended that the embodiment to be described is for use with a single pneumatic line which is adapted for bayonet fitting and which can provide either pneumatic suction or pressure by means of appropriate (remote) valves which form no part of the present invention. The present embodiment is constituted by a tool for attachment to such a line by means of a bayonet fitting, but it is intended that the invention could be constituted by a tool which either is an integral part of a larger apparatus or is attachable to at least one pneumatic line by other means such as a screw fitting.

The principal parts of the tool are a body 1, a union 2, a tube 3 and two probes constituted by tubes 4 and 5. The tubes 4 and 5 can be advanced relative to the tube 3 by means of pneumatic pressure and the central tube 3 can hold a length of tape by suction at its outer end. The body contains valves which will be described later.

Body 1 has an elongate rectangular form. At one end of the body is the union fitting 2 which is adapted for connection to a pneumatic line in a manner of no importance to the invention. The union 2 has an internal recess 6 which terminates in a bore 7 which is offset from, but parallel to, the longitudinal axis of the union 2.

Between the union 2 and the body 1 is a plate 8 which has, in the face adjacent the body 1, a narrow, central recess 9 for a purpose to be explained later. Through the plate extends a bore 10 which is aligned with the bore 7 in the union 2.

Figure 2:
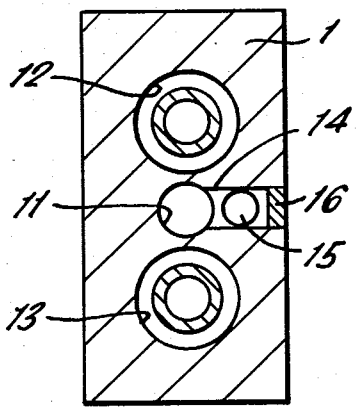
FIG. 2 is a view illustrating a section (on the line A—A) through the body forming part of the embodiment illustrated by FIG. 1.

The body 1 has a central bore 11 disposed between two larger bores, 12 and 13. Between the ends of the central bore 11 is a lateral port 14 which communicates with the bore 10 by means of a small bore 15 (FIG. 2) which is offset from but parallel to the central bore 11.

It is convenient to form the port 14 by drilling into the side of the body as far as the central bore, so as to connect the central bore and the small bore. The port 14 is blocked, outwardly of the small bore 15, by a plug 16.

Between the position of the port 14 and the proximal end (adjacent the plate 8) of the central bore 11, the central bore has a narrow part 17 which at its proximal end constitutes a valve seat 18 for a ball 19. The small chamber 20, constituted by the end part of the central bore 11, communicates with the somewhat larger bores 12, 13 by way of the recess 9 in the plate 8.

At its distal end the body 1 is partly closed by an inner apertured plate 21 in which the tubes 4 and 5 are slidable. An apertured plate 22 is disposed adjacent thereto. The plate 22 has a central aperture 23 in which the central tube 3, which extends forwardly from the body 1, is a loose fit, so that the plate 22 can slide on the tube 3. The plate 22 has two outer apertures 24 and 25 in which the tubes 4 and 5 are fixed, preferably by grub-screws (not shown).

Within the inner end of the tube 3 is a short bush 26 which is chamfered to provide a seat 27 for a ball 28. This ball is captive within the chamber 29 constituted by the central bore 11 between the seat 27 and another, opposite seat 30 formed where the central bore narrows, just beyond the position of the port 14.

In the bore 12 is disposed one end of the tube 4, which extends from the body 1 parallel to the tube 3 and terminates in a closed end 31, which in the retracted position of the tube 4 is abreast of the open end 32 of the tube 3. The tube 4 is narrower at its outer end than it is over the length which is disposed within the bore 12. A small aperture 33 is in a position near the outer end of the tube 4 and on the inner side of the tube 4; the aperture thus faces the central tube 3. The tube 5 has a similar aperture 33*a*.

At its inner end the tube 4 carries a piston head 34 which has a central bore 35 for a purpose to be described later. The head 34 has an external annular shoulder 36, the tube 4 abutting the shoulder and being fitted on an extension 37 of the head 34. The head carries an O-ring 38 which engages the wall of the bore 12.

Likewise the tube 5 carries a piston head 34*a* which has a central bore 35*a*, a shoulder 36*a* and an extension 37*a*, and the head is likewise associated with an O-ring 38*a*.

At its end the tube 3 carries a cross-bar 39 which has a central aperture in which the tube 3 is fixed and two outer apertures in which the tubes 4 and 5 can respectively slide. When the tubes 4 and 5 are fully retracted, their distal ends lie flush with the outer surface 40 of the cross-bar 39. The two tubes 4 and 5 may be circular in section but are preferably somewhat flattened, the minor axis of the cross-section of each tube being in the plane of the drawing.

A return spring 41 in helical form is disposed on the central tube 3 between the cross-bar 39 and the plate 22.

When suction is applied to the union 2 of the body, that suction is applied via the bores 7, 10 and 15 and the port 14 to the central chamber 29, between the valves, in the bore 11. The ball 19 is drawn down on to its seat 18 whereas the ball 28 is drawn away from its seat and there is pneumatic suction at the distal end of the tube 3. Thus the tool can pick up and support a length of adhesive tape, which can lie along the outer surface 40 of the cross-bar 39. On the supposition that the tape is to be applied round a cable or bundle of wires, the tool would then be moved by the robot that carries it to the required location and advanced so that the distal end of the tube 3 is close to or in engagement with the surface of the bundle of wires around which the tape is to be applied.

When pneumatic pressure is applied through the union, that pressure is communicated by way of the bores 7, 10 and 15 and the port 14 to the chamber 29. The ball 28 sits firmly on the seat 27. The ball 19 is lifted from its seat 18 so that pressure is applied by way of the chamber 20 and the narrow recess 9 to the piston heads 34, 34*a*. The piston heads, and therefore the tubes 4 and 5 move outwardly of the body against the force of the helical spring 41 to straddle the bundle of wires and as the tubes 4 and 5 are advanced forwardly of the tube 3, the air passing through the bores in the piston heads issues from the apertures 33 and 33*a* near the ends of the tubes 4 and 5. Thus there are provided directive jets which urge the two ends of the length of adhesive tape around the respective part of the cable or other article. The force of the jets becomes greater as the tubes 4 and 5 reach the ends of their permitted strokes. The suction to the tube 3 being cut off, the adhesive tape is released from the end of the tube 3 automatically.

When pneumatic pressure is cut off from the union 2, the outer tubes 4 and 5 retract, yielding to the force of the spring 41.

The two probes normally serve to wrap the tape mechanically partly round the article. The ends of the tape need not always be wrapped one over the other; it may be sufficient for the two ends to adhere to each other.

Several modifications of the described embodiment are feasible; the following list is not intended to be exhaustive.

In particular, instead of a single return spring disposed between on the central tube 3, return springs could be provided in the bores 12 and 13.

If a tool for applying greater length of tape were required, there could be more than one central tube 3. Moreover, since the outer tubes can act as guides for the tape, it might be possible to provide a lateral aperture in only one of them. Finally, although the valve arrangement is compact and convenient, especially for use with a single pneumatic line, a different arrangement would be necessary if, for example, the tool were designed for use with two pneumatic lines.

We claim:

1. A method of applying a length of adhesive tape around a cable, bundle of wires or other generally cylindrical object, comprising:

holding a length of the tape at the end of a tube by pneumatic suction;

moving the said end of the tube to a position adjacent the object;

advancing two probes, one on each side of and relative to the said tube so as to straddle the object; and providing a pneumatic jet laterally inwardly from at least one of the probes to blow a respective part of the tape around the object.

2. A method according to claim 1 in which the step of providing a pneumatic jet comprises applying pneumatic pressure to the respective probe to advance it relative to said tube, the probe conveying pneumatic pressure internally to a lateral aperture near a distal end of the probe.

3. A method according to claim 1 in which each probe provides a laterally directed pneumatic jet.

4. A tape-applying tool comprising a body, a tube extending from said body, said tube having a mouth, means for applying pneumatic suction to the tube, two elongate members mounted for longitudinal movement one on each side of the mouth of the said tube, means for applying pneumatic pressure to cause said members to advance relative to the mouth of the said tube, at least one of the members being adapted to convey said pressure and to provide a pneumatic jet across and in front of the mouth of said tube.

5. A tool according to claim 1 in which the said one member comprises a hollow piston.

6. A tool according to claim 1 further comprising means for progressively resisting the advance of the said one member.

7. A pneumatic tool for the application of adhesive tape around cables, bundles of wires and such like, comprising three hollow tubes of which at least the ends are disposed abreast, the tubes comprising a central tube which has an open end and two outer tubes of which at least one has a lateral aperture on its inner side, a body from which the tubes extend, the body being adapted for coupling to at least one pneumatic line, and means within the body for applying suction to the central tube and for applying pressure to the outer tubes to cause relative movement of the tubes such that the apertures are disposed forwardly of the central tube.

8. A tool according to claim 1 in which each outer tube has a closed end and an aperture as aforesaid, whereby pressure applied to the said outer tubes also provides pneumatic jets issuing from the apertures.

9. A tool according to claim 1 in which the said outer tubes are arranged for sliding movement with respect to the body and at least one spring is disposed to oppose the sliding movement.

10. A tool according to claim 1 in which the body includes an inlet port adapted for the reception of pressure or suction indifferently and two, oppositely acting, valves for automatically applying suction to the central tube and pressure to the said outer tubes.

11. A method of applying a length of tape having an adhesive surface and an opposite surface around a generally cylindrical object comprising: holding a length of the tape by engaging said opposite surface of the length of tape with the axially open end of a tube and applying pneumatic suction to the interior of the tube; arranging the tube and the cylindrical object such that the length of tape is adjacent the cylindrical object and at an angle to the axis of the article, said adhesive surface facing the object; advancing two hollow probes, one on each side of the tube, to positions beyond the open end of said tube so as to straddle the object; and supplying pneumatic pressure through the probes and discharging the pressure from the probes in the form of jets directed onto said opposite surface of the length of tape thereby blowing respective parts of the tape around the object.

* * * * *

UNITED STATES PATENT AND TRADEMARK OFFICE

CERTIFICATE OF CORRECTION

PATENT NO. : 4,351,684

DATED : September 28, 1982

INVENTOR(S) : Ralph D. Gibbons and Geoffrey G. Shackleford

It is certified that error appears in the above—identified patent and that said Letters Patent is hereby corrected as shown below:

Claim 3, line 1, change "1" to --2--.
Claim 5, line 1, change "1" to --4--.
Claim 6, line 1, change "1" to --5--.
Claim 8, line 1, change "1" to --7--.
Claim 9, line 1, change "1" to --8--.
Claim 10, line 1, change "1" to --8--

Signed and Sealed this

*Third* Day of *April 1984*

[SEAL]

*Attest:*

GERALD J. MOSSINGHOFF

*Attesting Officer*

*Commissioner of Patents and Trademarks*